US011358359B2

(12) United States Patent
Zensen

(10) Patent No.: US 11,358,359 B2
(45) Date of Patent: Jun. 14, 2022

(54) HYDRAULIC MACHINE UNIT AND METHOD FOR OPERATING SUCH A MACHINE UNIT

(71) Applicant: SMS group GmbH, Duesseldorf (DE)

(72) Inventor: Frank Zensen, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 0 days.

(21) Appl. No.: 15/741,334

(22) PCT Filed: Jun. 30, 2016

(86) PCT No.: PCT/DE2016/100294

§ 371 (c)(1),
(2) Date: Jan. 2, 2018

(87) PCT Pub. No.: WO2017/005245

PCT Pub. Date: Jan. 12, 2017

(65) Prior Publication Data

US 2018/0187702 A1 Jul. 5, 2018

(30) Foreign Application Priority Data

Jul. 3, 2015 (DE) ..... 10 2015 110 768.6

(51) Int. Cl.
*F15B 1/24* (2006.01)
*B30B 15/16* (2006.01)
(Continued)

(52) U.S. Cl.
CPC ..... *B30B 15/163* (2013.01); *B21J 9/12* (2013.01); *F15B 1/24* (2013.01); *F15B 11/20* (2013.01);
(Continued)

(58) Field of Classification Search
CPC ..... B21J 9/12; B30B 15/163; F15B 13/025; F15B 11/022; F15B 11/0325; F15B 2211/50554
See application file for complete search history.

(56) References Cited

U.S. PATENT DOCUMENTS 4,523,430 A * 6/1985 Masuda ..... B29C 45/82 417/222.1
4,588,539 A * 5/1986 Rossi ..... B30B 1/261 264/40.5
(Continued)

FOREIGN PATENT DOCUMENTS

CN 1057031 C 10/2000
CN 102674338 A 9/2012
(Continued)

OTHER PUBLICATIONS

JP 2000117801 A machine translation to English from espacenet (Year: 2000).*
(Continued)

*Primary Examiner* — F Daniel Lopez
*Assistant Examiner* — Michael Quandt
(74) *Attorney, Agent, or Firm* — Collard & Roe, P.C.

(57) ABSTRACT

A hydraulic machine unit that can be operated with various working forces, in which working medium is selectively delivered, via a pump-piston accumulator system, to a main cylinder and at least one driving cylinder, wherein at least for one working stroke a pump system of the pump-piston accumulator system is used to provide working medium to a piston accumulator of the pump-piston accumulator system, and then at least for the working stroke at least the main cylinder is charged with a working pressure from the piston accumulator, and wherein at least for a return stroke the at least one driving cylinder is charged with a return stroke pressure from the pump-piston accumulator system, can be
(Continued)

Figure 1:
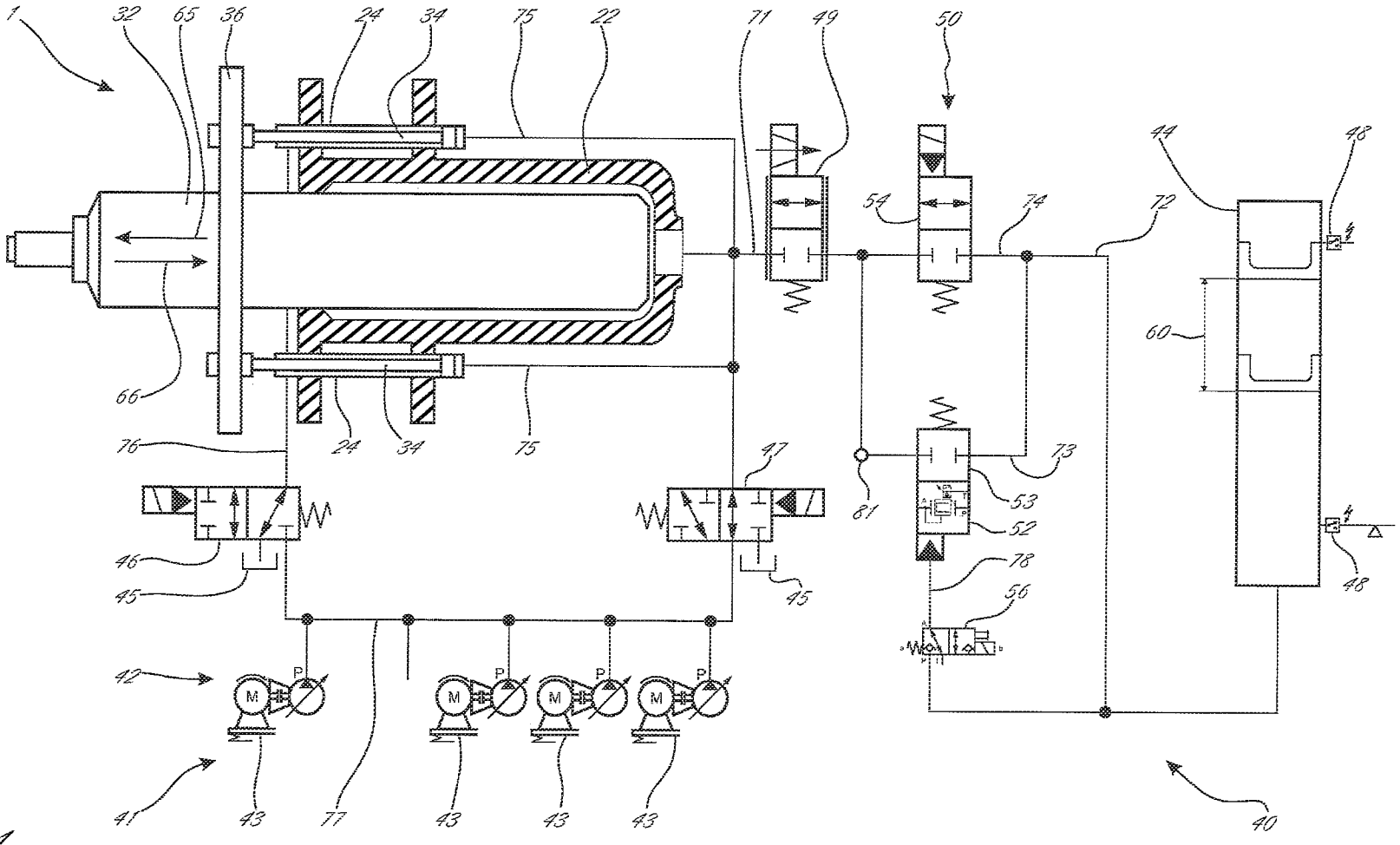

of structurally simple configuration if, at reduced working forces, the working pressure is reduced with respect to the piston accumulator pressure prevailing in the piston accumulator.

8 Claims, 2 Drawing Sheets

(51) Int. Cl.
*B21J 9/12* (2006.01)
*F15B 11/20* (2006.01)
*F15B 13/02* (2006.01)

(52) U.S. Cl.
CPC ... *F15B 13/025* (2013.01); *F15B 2211/20576* (2013.01); *F15B 2211/212* (2013.01); *F15B 2211/50554* (2013.01); *F15B 2211/55* (2013.01); *F15B 2211/7107* (2013.01); *F15B 2211/775* (2013.01)

(56) References Cited

U.S. PATENT DOCUMENTS

| | | | | |
|---|---|---|---|---|
| 5,309,944 | A | 5/1994 | Chikamatsu et al. | |
| 5,355,676 | A | 10/1994 | Inokuchi | |
| 5,551,276 | A | 9/1996 | Hild | |
| 7,001,545 | B2 * | 2/2006 | Okado | B29C 43/58 264/40.1 |
| 8,156,780 | B2 * | 4/2012 | Fellenberg | B21D 28/02 72/324 |

FOREIGN PATENT DOCUMENTS

| | | | | |
|---|---|---|---|---|
| CN | 103057159 | A | | 4/2013 |
| CN | 103057160 | A | | 4/2013 |
| CN | 202937882 | U | | 5/2013 |
| CN | 204020051 | U | | 12/2014 |
| DE | 40 03 016 | A1 | | 8/1991 |
| DE | 43 16 637 | C2 | | 11/1993 |
| EP | 0 190 866 | A2 | | 8/1986 |
| EP | 0 629 455 | B1 | | 12/1994 |
| EP | 2 597 317 | A1 | | 5/2013 |
| JP | H04-151004 | A | | 5/1992 |
| JP | 2000117801 | A | * | 4/2000 |
| JP | 2007-162387 | A | | 6/2007 |

OTHER PUBLICATIONS

German Office Action in DE 10 2015 110 768.6, dated Mar. 21, 2016, with English translation of relevant parts.

International Search Report of PCT/DE2016/100294, dated Nov. 4, 2016.

O & P—Oelhydraulik Und Pneumatik, Grundlagen der hydraulischen Schaltungstechnik vol. 38, No. 3, Jan. 1, 1994, 4 pages.

O. & P.—Oelhydraulik Und Pneumatik, "Principles of hydraulic circuitry"—Grundlagen der hydraulischen Schaltungstechnik, vol. 38, No. 3, Jan. 1, 1994, pp. 88, 90, 93, and 94.

English translation of Chinese Office Action in CN 201680038802.9, dated Jul. 24, 2019.

Japanese Office Action in Application No. 2017-566389 dated Aug. 2, 2020.

* cited by examiner

HYDRAULIC MACHINE UNIT AND METHOD FOR OPERATING SUCH A MACHINE UNIT

CROSS REFERENCE TO RELATED APPLICATIONS

This application is the National Stage of PCT/DE2016/100294 filed on Jun. 30, 2016, which claims priority under 35 U.S.C. § 119 of German Application No. 10 2015 110 768.6 filed on Jul. 3, 2015, the disclosure of which is incorporated by reference. The international application under PCT article 21(2) was not published in English.

The invention relates to a hydraulic machine unit that can be operated at different working forces, comprising a main cylinder in which a main piston is disposed, at least one drive cylinder, the drive piston of which is connected to act together with the main piston, and a pump/piston accumulator system, which has a pump system and a piston accumulator connected with the pump system, as a hydraulic drive for the main cylinder and the at least one drive cylinder. Likewise, the invention relates to a method for operation of a hydraulic machine unit that can be operated at different working forces, in which method working medium is selectively delivered to a main cylinder and at least one drive cylinder, by way of a pump/piston accumulator system, wherein working medium is made available in a piston accumulator of the pump/piston accumulator system, at least for one work stroke, by way of a pump System of the pump/piston accumulator system, and then a working pressure from the piston accumulator is applied at least to the main cylinder, at least for the work stroke, and wherein a return stroke pressure from the pump/piston accumulator system is applied to the at least one drive cylinder, at least for the return stroke.

For example, for operation of a hydraulic extruder as such a hydraulic machine unit, the drive cylinder(s) is/are loaded on their ring pistons with different working forces, referred to as pressing forces, even in the case of a work stroke in the return stroke direction, at the working pressure that acts on the main piston. In this manner, the working forces can be reduced in accordance with the surface area ratios between the ring surfaces of the drive cylinders and the main piston surface. For a maximal working force, supplementally, the piston surfaces of the drive cylinder or of the drive cylinders can also be loaded with the working pressure. Further working force levels can be achieved by means of further drive cylinders, particularly for reasons of symmetry and to prevent tilting moments caused by further drive cylinder pairs, in each instance, which levels are provided supplementally and can be operated selectively, accordingly. For example, an upsetting press main, drive is known from EP 0 629 455 B1, but this drive comprises only return stroke pistons and cylinders in addition to a main piston and main cylinder.

It is the task of the present invention to configure machine units of the stated type and operating methods of the stated type with variable working forces, in structurally simple manner.

The task of the invention is accomplished by means of hydraulic machine units and by means of methods for operation of such machine units, having the characteristics of the independent claims. Further advantageous embodiments, possibly also independent of these, are found in the dependent claims and in the following description.

For example, a hydraulic machine unit that can be operated at different working forces, comprising a main cylinder in which a main piston is disposed, at least one drive cylinder, the drive piston of which is connected to act together with the main piston, and a pump/piston accumulator system, which has a pump system and a piston accumulator connected with the pump system, as a hydraulic drive for the main cylinder and the at least one drive cylinder, has a relatively simple construction if the machine unit is characterized in that the piston accumulator is hydraulically connected with the main cylinder by way of a work stroke control valve that comprises a proportional pressure-reducing valve.

Likewise, it is possible to configure a corresponding machine unit in structurally simple manner, if this unit is operated by means of a method for operation of a hydraulic machine unit that can be operated at different working forces, in which method working medium is selectively delivered to a main cylinder and at least one drive cylinder, by way of a pump/piston accumulator system, wherein working medium is made available in a piston accumulator of the pump/piston accumulator system, at least for one work stroke, by way of a pump system of the pump/piston accumulator system, and then a working pressure from the piston accumulator is applied at least to the main cylinder, at least for the work stroke, and wherein a return stroke pressure from the pump/piston accumulator system is applied to the at least one drive cylinder, at least for the return stroke, which method is characterized in that at reduced working forces, the working pressure is reduced as compared with the piston accumulator pressure that prevails in the piston accumulator.

In this regard, the pressure reduction of the piston accumulator pressure, before this pressure is passed on, as a working pressure, to the main cylinder and, if applicable, to the drive cylinder(s), brings about the result that it is possible to eliminate complex counter-pressures by way of the drive cylinder(s), and, in particular, it is not necessary to provide further drive cylinders or further drive cylinder pairs in order to operate the hydraulic machine unit at different working forces.

Since at least one drive cylinder is provided for the return stroke, in any case, it is understood that the drive cylinder(s), if applicable, can nevertheless be controlled accordingly, in active manner, so that more than four different working force levels can be implemented, without supplemental design measures or construction measures: In the first working force level, the piston accumulator pressure is conducted both in the main cylinder and also, on the piston side, into the drive cylinder(s); in the second level, this is eliminated on the side of the drive cylinder(s); and in the third and fourth level, a counter-pressure takes place by way of the ring surfaces of the drive cylinder or of the drive cylinders, something that can also happen with and without loading of the piston surface of the drive cylinder or of drive cylinders. Further working force variations can then be implemented by way of the corresponding pressure reduction of the piston accumulator pressure to a lower working pressure, wherein a reduced piston accumulator pressure can also be delivered to the drive cylinder(s), if applicable, on the piston side or on the ring surface side, depending on the requirements, without additional structural measures and merely by means of adding further hydraulic lines and valves. In this way, almost any working force can therefore be implemented. Thus, working forces between approximately 40% and 90% of the maximal working force can be implemented without additional measures, in particular also without taking into consideration different control of the drive cylinder or of the drive cylinders, solely by means of the pressure reduction, wherein the upper limit of this interval is determined by the pressure losses above the pressure-reducing valve. This range can also be expanded by means of further circuitry, as has already been explained above and will still be explained below. It is understood that the advantages of the work stroke control valve that comprises a proportional pressure-reducing valve can be utilized even without by working force levels that can be implemented by way of the drive cylinder(s), in order to guarantee infinite working force variation in the work range of the proportional pressure-reducing valve if the entire controller is suitably designed.

The reduction of the piston accumulator pressure as compared with the working pressure by means of a corresponding hydraulic measure, such as a pressure-reducing valve, thereby allows an increase in the variability with regard to the delivered working forces of the hydraulic machine unit without complex further structural mechanical measures. It is understood that proceeding from this basic idea, the most varied hydraulic circuits can be provided in different combinations, in order to implement various or different working force levels or working forces with a hydraulic machine unit that is structured minimalistically with regard to the number of drive cylinders.

The greater freedoms with regard to the different working forces with which such a hydraulic machine unit can be operated make it possible to adapt a machine unit having the same construction to different customer requests without any changes in design, since the working force levels desired by the customer merely have to be suitably controlled as combinations of the different hydraulic circuit paths. The working forces can be infinitely selected within the scope of the variability of the pressure-reducing valve.

Preferably—depending on the concrete implementation of the present invention—the return stroke will be controlled merely by way of the pump system of the pump/piston accumulator system, because here no great volume streams are to be expected. Likewise, displacements in the direction of the work stroke, if they take place slowly, can be controlled from the pump system of the pump/piston accumulator system, as long as the volume streams that occur in this regard are sufficiently slight and can be managed by the pump system. The piston accumulator generally serves essentially for allowing high speeds of the main piston, since here, large volume streams are required. This allows reducing the number of pumps, for example, and reducing it from twenty-four required pumps to eight pumps, for example.

The piston accumulator can be discharged from a maximal charging pressure down to a minimal charging pressure, wherein it is ensured in the method management that the charging pressure of the piston accumulator is greater than the required pressure.

It is understood that these advantages are present even in the case of a reversal of the direction of action of the drive pistons, in other words if the piston surface of the drive pistons is designed for the return stroke, and the ring surfaces of the drive piston are designed for the work stroke.

The use of a proportional pressure-reducing valve between the piston accumulator and the main cylinder, for a reduction of the working pressure, or the placement of such a proportional pressure-reducing valve between the piston accumulator and the main cylinder for adaptation of the working forces is particularly advantageous. The degree of the pressure reduction can be reduced infinitely or almost infinitely, within certain limits, by way of such a proportional pressure-reducing valve, and thereby the freedoms with regard to design of the hydraulic machine unit can be further increased, and consequently a standard machine unit can meet diverse customer demands with regard to diversity in the working forces.

In particular, the proportional pressure-reducing valve can be pre-controlled. By means of pre-control and the connection with the piston accumulator, it is possible to make great volume streams available in particularly simple manner and within a short period of time.

Preferably, pre-control takes place by means of a control valve or by way of a control line, something that can be easily implemented and can make the setting forces to be applied available in relatively simple manner.

Preferably, the proportional pressure-reducing valve can be locked, so that it can be actively turned on and off. This particularly allows preventing possible interferences if the proportional pressure-reducing valve is not supposed to be used for some reason, for example for the reasons still to be explained below.

In order to configure the proportional pressure-reducing valve to be lockable, this can particularly be combined with a locking way valve, which accordingly makes structurally simple implementation possible.

In a preferred embodiment, the proportional pressure-reducing valve is turned off or shut off and/or locked or closed in the current-free state; this particularly serves for operational safety.

Preferably, the work stroke control valve comprises a bypass valve configured as a way valve, parallel to the proportional pressure-reducing valve, by way of which way valve the piston accumulator pressure can be made available when the full working pressure is required, without any additional pressure reduction in the direction of the main cylinder or drive cylinder.

Likewise, it is advantageous, accordingly, that the working medium is delivered to the main cylinder or to the drive cylinder(s) by way of a bypass at maximal working forces.

In this regard, it is particularly advantageous if the bypass valve or the bypass is open by way of its hydraulic, pneumatic or electrical controller when the pressure-reducing valve is locked or otherwise closed by way of its corresponding controller, so that malfunctions can be prevented in this regard, by way of the regulator or controller. If necessary, corresponding shuttle valves can also be mechanically coupled, or combined in a single way valve.

Preferably, the proportional pressure-reducing valve is configured with feedback or controlled in a closed regulation circuit. This allows precise monitoring of the ultimately acting working pressure and of the respective working forces that result from it.

In this regard, the feedback preferably takes place on the plunger side, thereby making it possible to restrict vibration effects or also interference from the pump system to a minimum. For example, the pressure can be recorded on the plunger side for feedback, and this pressure can then be fed back on the piston accumulator side, in particular. It has been shown that possible vibration effects or interference do/does not play a role here. In particular, it is conceivable to configure the feedback by way of a way valve, if applicable even by way of a logic way valve as a control valve, so that the proportional pressure-reducing valve can be relieved of stress when it is not being used and is turned off or switched off or blocked.

The proportional pressure-reducing valve can particularly comprise a valve that goes into a floating position, preferably during its reducing function, until the reduced pressure agrees with a predetermined reference value, so that extremely high volume streams can be conducted. This corresponds to the situation that the piston accumulator is specifically provided for making such high volume streams available within the shortest period of time, at sufficient pressure for the main cylinder. If the reduced pressure or the plunger-side pressure agrees with a predetermined reference value, the floating position will preferably close, and the corresponding reduced pressure is delivered to the cylinders as a working pressure, so that a corresponding default value of the working pressure can be maintained by way of feedback or by way of a closed regulation circuit.

As was already explained above, in the present case the proportional pressure-reducing valve is preferably configured in such a manner that it is closed in its basic position, contrary to a conventional reduced function. This particularly also serves for increased operational safety.

For the reason indicated above, it is accordingly advantageous if the bypass valve is closed in its basic position.

It is understood that if particular circumstances, such as an increase in force in the return stroke, for example, make it necessary, more than one or two drive cylinders can also be provided, wherein then, the advantage of the significant reduction in construction effort is accordingly lost. Nevertheless, the great flexibility in the selection of the working force levels or working forces remains. However, it is particularly advantageous, in terms of construction, if precisely two drive cylinders are provided, since they already permit a corresponding reduction in working force by way of the pressure reduction, without any further structural measures. Likewise, it is understood that extremely simple implementation, in terms of construction, is possible by providing only precisely one drive cylinder.

By way of the proportional pressure-reducing valve, in particular, approximately 40% to 90% of the maximal working force, in other words of the maximal working pressure or of the piston accumulator pressure can be variably delivered to the cylinders. The latter can, however, also be implemented also with unregulated or with simpler pressure-reducing valves—if applicable even at a greater bandwidth.

Any working medium that is suitable for hydraulics can be used as a working medium, with oil being preferred. Alternatively, water or emulsions or water/oil mixtures, in particular, can also be used.

The solutions described above are particularly suitable for hydraulic machine units that comprise a pump/piston accumulator system as a hydraulic drive. Accordingly, the solutions described above are particularly suitable for hydraulic or hydraulically driven piston accumulator system units. In particular, forming machines are suitable that implement the solutions described above as corresponding machine units or piston accumulator system units, specifically if very great forming forces, such as pressing forces or similar working forces are required, and therefore pump/piston accumulator systems are used as a drive, particularly also in order to be able to implement correspondingly large strokes quickly. Corresponding solutions can be used, in particular, in the case of forming machines configured as extruders or forging presses, since particularly great volume streams and pressure must be used in these presses, in view of the very large plunger cylinders as main cylinders and plungers as main pistons. Thus, such presses work at a maximal loading pressure above 250 HPa (bar) in the case of piston accumulators, particularly above 300 HPa or above 320 HPa. After removal or after a pressing procedure, more than 50% of the maximal loading pressure can generally still be found in a corresponding piston accumulator.

It is understood that the characteristics of the solutions described above and in the claims can also be combined, if necessary, in order to be able to implement the advantages cumulatively, accordingly.

Figure 2:
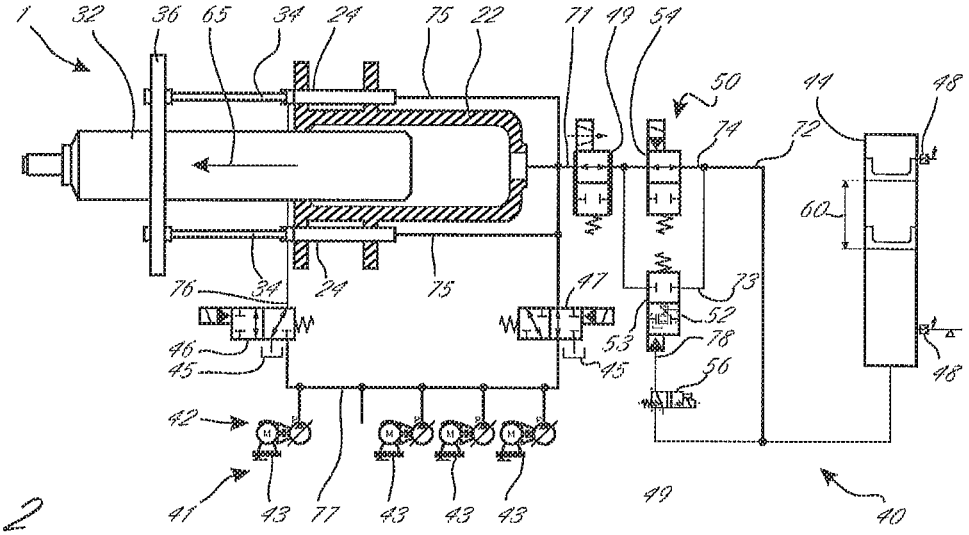
Figure 3:
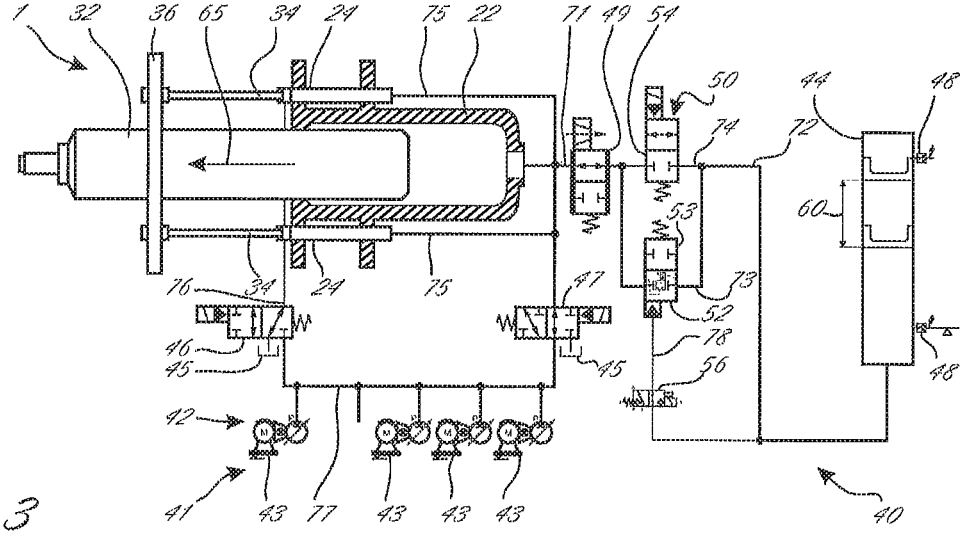
Figure 4:
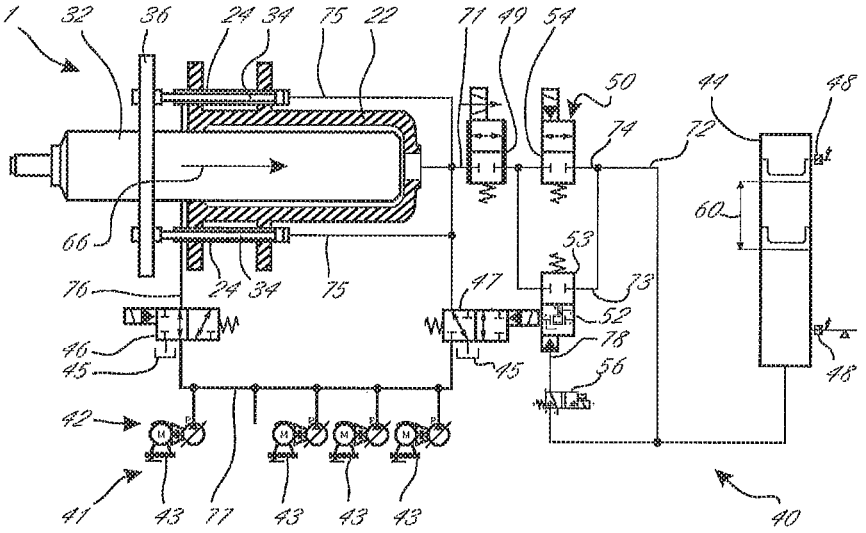

Further advantages, goals, and properties of the present invention will be explained using the following description of exemplary embodiments, which are particularly also shown in the attached drawing. The drawing shows:

FIG. 1 a schematic representation of a hydraulic machine unit that can be operated at different working forces;

FIG. 2 the machine unit according to FIG. 1 at a maximal working force;

FIG. 3 the machine unit according to FIGS. 1 and 2 at a reduced working force; and FIG. 4 the machine unit according to FIGS. 1 to 3 during the return stroke.

The machine unit 1 shown in the figures is an extruder and comprises a main cylinder 22 also referred to as a plunger cylinder, in which a main piston 32, also referred to as a plunger, is disposed to be displaceable axially in a work direction and in a return stroke direction, wherein drive pistons 34 are provided on the main piston 32 by way of a cross beam 36, which pistons can accordingly be displaced in drive cylinders 24. It is understood that in deviating embodiments, only one drive cylinder, which can also be disposed centrally, can also be provided, if necessary. Because of their lateral placement, the drive cylinders 24 and the drive pistons 34 are frequently also referred to as side cylinders and pistons.

In order to drive the main piston 32 and the drive pistons 34, a hydraulic drive 40 is provided, which comprises a pump/piston accumulator system 41. The pump/piston accumulator system 41 in turn comprises a pump system 42, on the one hand, in which multiple pumps 43 are switched in parallel by way of pump lines 77, wherein the number of pumps 43 depends on the required pressures and the amounts of working medium to be handled. Furthermore, the pump/piston accumulator system 41 comprises a piston accumulator 44, on the other hand, in which working medium under pressure can be made available in a sufficient volume amount.

Likewise, the hydraulic drive 40 comprises a tank 45, in which working medium that runs off is collected, and from which the pumps 43 can take up working medium.

The pump system 42 can be applied to the ring surfaces of the drive pistons 34 by means of a return stroke line 76, by way of a return stroke control valve 46, while it can be applied to a main piston line 71, by way of which the main cylinder 22 can be supplied with a working pressure, by way of a working pressure control valve 47. Both the return stroke control valve 46 and the working pressure control valve 47 are structured as way valves in this exemplary embodiment, and allow emptying of the main piston line 71 or of the return stroke line 76 into the tank 45, in each instance, when pressure is applied to the other one of these lines and this appears practical due to general hydraulic conditions.

The main piston line 71 is connected with a piston accumulator line 72 by way of a proportional valve 49 and a work stroke control valve 50; this line in turn is connected with the piston accumulator 44. In this manner, the pressure or the volume from the piston accumulator 44 can be delivered to the cylinders 22, 24 by way of the proportional valve 49 and the work stroke control valve 50, or, alternatively, the piston accumulator 44 can be loaded by the pump system 42, wherein the proportional valve 49 particularly serves to prevent overly rapid emptying of the piston accumulator 44, and wherein the work stroke control valve 50 is configured in special manner in the present exemplary embodiment, as will be explained below. When the main piston 32 works, a withdrawal volume 60 is withdrawn from the piston accumulator 44 accordingly.

The piston accumulator 44 furthermore comprises sensors 48 that record the respective fill level, in this exemplary embodiment a maximal fill level and a minimal fill level, and output it to the controller as an electrical signal.

Furthermore, the main piston line 71 is also connected with drive cylinder lines 75, which in turn are connected with the drive cylinders 24, so that working pressure can also be delivered to the drive cylinders 24.

It is understood that—depending on the concrete embodiment of this exemplary embodiment—the drive cylinders lines 75 and also the return stroke lines 76 can have further valves, which uncouple them from the main piston line 71 or can couple them back to it, if this appears practical for reasons of control technology, weighed against the correspondingly greater construction effort in the hydraulic drive 40 and in its electrical or electronic setup.

In distinction from the state of the art, the work stroke control valve 50 of the present exemplary embodiment comprises a proportional pressure-reducing valve 52 that is combined with a locking way valve 53, a bypass valve 54, and a control valve 56, wherein the proportional pressure-reducing valve 52 is disposed in a reduction line 73 and connected, with feedback, with the piston accumulator line 72, by way of a control line 78 and the control valve 56, and the bypass valve 54 is disposed in a bypass 74, which is switched in parallel with the reduction line 73. Accordingly, the work stroke control valve 50 comprises the proportional pressure-reducing valve 52 and the bypass valve 54, which are switched in parallel with one another, and the control valve 56, which can allow or interrupt feedback of the proportional pressure-reducing valve 52 to the piston accumulator line 72 in the form of a logic way valve.

In the present exemplary embodiment, the bypass 74 is configured with the least possible pressure loss, in other words as straight-line as possible—since the maximal working pressure is supposed to be made available by way of the bypass 74 and the bypass valve 54, which is also configured as a way valve, and for this reason, possible pressure losses between the piston accumulator 44 and the main piston line 71 or the drive cylinder lines 75 are supposed to be restricted to a minimum.

It is understood that a path to the return stroke lines 76, which can be turned on or off, can also be selected by the proportional pressure-reducing valve 52, for example. Likewise, it is conceivable that additional valves are provided, by means of which the pressure reduced by means of the proportional pressure-reducing valve 52 can be delivered to the drive cylinder lines 75 separately, in order to further increase the variability with regard to the working force in this manner, if this appears to be justified in view of the slightly increased construction effort. Likewise, it is conceivable to provide a further proportional pressure-reducing valve 52, if necessary also with a separate control valve 56, for these purposes.

It is furthermore understood that the return stroke control valve 46 and the working pressure control valve 47 can also be connected slightly differently or, alternatively, with other locations, without losing the advantages of pressure reduction between piston accumulator 44 and the cylinders 22, 24.

In the present exemplary embodiment, the proportional pressure-reducing valve 52 and the control valve 56 are switched in such a manner that they are each closed, by way of a way valve setting, in the basic position. The bypass valve 54 is also closed in the basic position, wherein corresponding control then prevents simultaneous opening of the valves 52, 54. When the bypass valve 54 is open, the maximal working pressure can be made available by way of the work stroke control valve 50. In an alternative embodiment, it is also conceivable to combine the pressure-reducing valve 52 and the bypass valve 54 in a single way valve. The proportional valve 49 is also closed in its basic position.

If a reduced working force is to be made available, as compared with the maximal working pressure and the working force resulting from it, the bypass valve 54 is closed and the proportional pressure-reducing valve 52 as well as the control valve 56 are opened, so that feedback of the proportional pressure-reducing valve 52 to the piston accumulator line 72 can take place by way of the control line 78, and a corresponding reduced pressure can be made available as a working pressure by way of the proportional pressure-reducing valve 52. Also, a plunger measurement 81 is performed on the plunger side, which makes it possible to control the proportional pressure-reducing valve 52.

The proportional pressure-reducing valve 52 goes into a floating position during the reduction function, until the reduced pressure agrees with the predetermined reference value, so that a corresponding default value of the working pressure can be maintained by way of a feedback or by way of a closed regulation circuit.

As is directly evident, the reduced pressure is measured on the side that runs off with respect to the working medium, in other words on the main piston side, and fed back to the proportional pressure-reducing valve 52.

It is understood that the hydraulics described above are merely an example and can also be configured differently in detail, as long as the piston accumulator 44, in particular, can act on the main piston 32 with reduced pressure or by way of a proportional pressure-reducing valve 52. In particular, supplemental lines and valves can also be provided, in order to be able to represent yet other operating situations. Likewise, it is understood that safety valves and switches as well as other additional measures can also be implemented. Likewise, it is understood that any working medium that is suitable for hydraulics can be used as a working medium, wherein oil is used in the present exemplary embodiment. Alternatively, water or an emulsion or an oil/water mixture, in particular, can also be used.

If the main piston 32 is to be moved in the work stroke direction 65 with maximal working force, then for this purpose, as shown in FIG. 2, the working pressure control valve 47 is opened, and the return stroke control valve 46 is closed, so that the return stroke line 76 to the tank 45 is open. Likewise, the valve 52 and 56 are closed, and the bypass valve 54 is opened. The pump system 42 then acts directly on the cylinders 22, 24, while the speed of the main piston 32 can be mastered by way of the proportional valve 49, which ultimately acts as an adjustable shutter. It is understood that reduced working force levels can be achieved, if necessary, in that the return stroke control valve 46 is also opened, and thereby the pump system 42 can also act on the ring surface of the drive piston 34. Likewise, if necessary, valves can also be provided in the drive cylinder lines 75, which are closed, if necessary, in order to also lower the working force in step-like manner.

Actually, however, in the present exemplary embodiment, the working force is reduced by way of the proportional pressure-reducing valve 52, as shown in FIG. 3. For this purpose, the bypass valve 54 is closed and the control valve 56 is opened, so that a pressure from the piston accumulator 44, which also acts on the main piston 32 by way of the proportional valve 49, which pressure is reduced in desired manner, can be made available at the proportional pressure-reducing valve 52. With regard to valve control of the working pressure control valve 47, the return stroke control valve 46, and the proportional valve 49, it is then possible to proceed, ultimately, as in the case of maximal working force, in order to guarantee the desired movement of the main piston 32 at the given reduced working force.

If necessary, only hydraulic control of the drive cylinders 24 can also take place for a fast stroke in the work stroke direction 65, if the main piston ultimately has the required volume made available to it from the pump/piston accumulator system 41 or from the piston accumulator 44, if necessary at a reduced pressure and, if necessary, also with slight suction. For this purpose, further valves and lines can also be provided, if necessary.

For the return stroke in the return stroke direction 66, as shown in FIG. 4, the return stroke control valve 46 is opened and the working pressure control valve 47 as well as the proportional valve 49 are closed, so that the main piston line 71 and the drive cylinder lines 75 are relieved of stress into the tank 45, while the piston accumulator 44 does not lose any further pressure. The pump system 42 of the pump/piston accumulator system 41 then acts on the ring surfaces of the drive pistons 24 and pushes the main piston 32 in the return stroke direction. It is conceivable, if applicable, that during this time, the piston accumulator 44 is loaded up again by way of a line that can be turned on separately, something that otherwise can take place, of course, during possible dead times or auxiliary process times, by way of the piston accumulator line 72, by means of the proportional valve 49 and the bypass valve 54.

It is understood that instead of the machine unit described above, configured as an extruder, a corresponding hydraulic drive can also be used in other types of machine units, particularly in the case of other piston accumulator system units or forming machines, for example in forging presses.

REFERENCE SYMBOL LIST

1 machine unit
22 main cylinder
24 drive cylinder
32 main piston
34 drive piston
36 cross beam
40 oil-hydraulic drive
41 pump/piston accumulator system
42 pump system
43 pump
44 piston accumulator
45 tank
46 return stroke control valve
47 working pressure control valve
48 sensor
49 proportional valve
50 work stroke control valve
52 proportional pressure-reducing valve
53 locking way valve
54 bypass valve
56 control valve
60 withdrawal volume
65 work stroke direction
66 return stroke direction
71 main piston line
72 piston accumulator line
73 reduction line
74 bypass
75 drive cylinder line
76 return stroke line
77 pump line
78 control line
81 pressure measurement

The invention claimed is:

1. A hydraulic machine unit that can be operated at different working forces, comprising:

a main cylinder in which a main piston is disposed, at least one drive cylinder, a drive piston connected to act together with the main piston, a pump/piston accumulator system, which has a pump system and a piston accumulator connected with the pump system, as a hydraulic drive for the main cylinder and the at least one drive cylinder, and a work stroke control and proportional pressure valve system hydraulically connecting the piston accumulator with the main cylinder, the work stroke control and proportional pressure valve system comprising a work stroke control valve and a proportional valve, the work stroke control valve hydraulically connecting the piston accumulator with the main cylinder, the work stroke control valve comprising a proportional pressure-reducing valve and a bypass valve configured as a two way valve, parallel to the proportional pressure-reducing valve, the pump system applied to a main piston line, by way of which the main cylinder can be supplied with a working pressure, by way of a working pressure control valve, the main piston line being connected with a piston accumulator line by way of the proportional pressure-reducing valve and the bypass valve, wherein the piston accumulator line is in turn connected with the piston accumulator, the main piston line being connected to the pump system on one hand, and to the work stroke control and proportional pressure valve system as well as the main cylinder, on the other hand, wherein the piston accumulator can be loaded by the pump system via the work stroke control and proportional pressure valve system.

2. The hydraulic machine unit according to claim 1, wherein the proportional valve is in series with the proportional pressure-reducing valve and makes a determined volume stream available.

3. The hydraulic machine unit according to claim 1, wherein the working pressure control valve is connected with the piston accumulator line by way of the work stroke control and proportional pressure valve system.

4. The hydraulic machine unit according to claim 1, wherein the volume from the piston accumulator can be delivered to the cylinders by way of the proportional valve.

5. A method for operation of a hydraulic machine unit that can be operated at different working forces, the method comprising:

selectively delivering a fluid working medium to a main cylinder and at least one drive cylinder, by way of a pump/piston accumulator system, making working medium available in a piston accumulator of the pump/piston accumulator system, at least for one work stroke, by way of a pump system of the pump/piston accumulator system, hydraulically connecting the piston accumulator with the main cylinder by way of a work stroke control and proportional pressure valve system, the work stroke control and proportional pressure valve system comprising a work stroke control valve and a proportional valve, the work stroke control valve comprising a proportional pressure-reducing valve and a bypass valve configured as a two way valve, parallel to the proportional pressure-reducing valve, then applying a working pressure from the piston accumulator at least to the main cylinder, at least for the work stroke, applying a return stroke pressure from the pump/piston accumulator system to the at least one drive cylinder, at least for the return stroke, reducing the working pressure as compared with the piston accumulator pressure prevailing in the piston accumulator, such that a reduced working force is made available, applying the pump system to a main piston line, by way of which the main cylinder is supplied with a working pressure, by way of a working pressure control valve, connecting the main piston line with the piston accumulator by way of the proportional pressure-reducing valve and the bypass valve, wherein a piston accumulator line is in turn connected with the piston accumulator, and delivering the pressure or the volume from the piston accumulator to the cylinders by way of the work stroke control and proportional pressure valve system, wherein the reduction of the working pressure occurs via the work stroke control and proportional pressure valve system placed between the piston accumulator and the main cylinder, wherein the main piston line connects to the pump system on one hand, and to the work stroke control and proportional pressure valve system, on the other hand, and wherein the piston accumulator is loaded by the pump system via the work stroke control and proportional pressure valve system.

6. The operating method according to claim 5, wherein at maximal working forces, the working medium is delivered to the main cylinder or to the at least one drive cylinder by way of a bypass.

7. The operating method according to claim 5, wherein the working pressure control valve is connected with the piston accumulator line by way of the work stroke control and proportional pressure valve system.

8. The operating method according to claim 5, wherein the volume from the piston accumulator is delivered to the cylinders by way of the proportional valve.

* * * * *